US012653358B2

(12) United States Patent
Alder et al.

(10) Patent No.: US 12,653,358 B2
(45) Date of Patent: Jun. 16, 2026

(54) BATHTUB SUPPORT POLE

(71) Applicant: Stander, Inc., Logan, UT (US)

(72) Inventors: Kip Alder, Nibley, UT (US); Joshua Snider, Paradise, UT (US)

(73) Assignee: STANDER, INC., Logan, UT (US)

( * ) Notice: Subject to any disclaimer, the term of this patent is extended or adjusted under 35 U.S.C. 154(b) by 127 days.

(21) Appl. No.: 18/604,839

(22) Filed: Mar. 14, 2024

(65) Prior Publication Data

US 2024/0315501 A1 Sep. 26, 2024

Related U.S. Application Data

(60) Provisional application No. 63/491,912, filed on Mar. 23, 2023.

(51) Int. Cl.
*A47K 17/02* (2006.01)

(52) U.S. Cl.
CPC ..... *A47K 17/022* (2013.01)

(58) Field of Classification Search
CPC ..... A47K 17/022
USPC ..... 4/571.1
See application file for complete search history.

(56) References Cited

U.S. PATENT DOCUMENTS

| | | | | |
|---|---|---|---|---|
| 1,797,911 | A | 3/1931 | Edward et al. | |
| 2,981,959 | A | 5/1961 | Burnham | |
| 3,018,898 | A | 1/1962 | Frazelle | |
| 3,114,154 | A * | 12/1963 | Laughlin | A47K 3/003 4/576.1 |
| 3,327,310 | A | 6/1967 | Bethune et al. | |
| 3,350,120 | A | 10/1967 | Hinrichs | |
| 3,519,293 | A | 7/1970 | Henning et al. | |
| 3,553,746 | A | 1/1971 | Seiger | |
| 3,606,402 | A | 9/1971 | Medney | |
| 3,822,850 | A | 7/1974 | Elias | |
| D242,671 | S | 12/1976 | Thomas | |
| 4,101,036 | A | 7/1978 | Craig | |
| 4,238,164 | A | 12/1980 | Mazzolla | |

(Continued)

FOREIGN PATENT DOCUMENTS

| | | |
|---|---|---|
| DE | 1805421 B2 | 7/1976 |
| DE | 19840854 A1 | 3/2000 |
| JP | 10234789 | 9/1998 |

OTHER PUBLICATIONS

Notice of Allowance dated Feb. 17, 2016 for U.S. Appl. No. 14/174,679.

(Continued)

*Primary Examiner* — Lauren A Crane
(74) *Attorney, Agent, or Firm* — Dorsey & Whitney LLP

(57) ABSTRACT

A bathtub support pole can be fixated between a ceiling and a wall of a bathtub. The bathtub support pole includes a support member, and a height adjustment component. The support member has a first end mountable to a ceiling and a second end mountable to the wall of the bathtub. The height adjustment component is located on the support member and is configured to adjust a length of the bathtub support pole between the first end and the second end to fix the first end of the support member against the ceiling and the second end of the support member against the wall of the bathtub. The second end of the support member encompasses a portion of a rim of the bathtub and opposing sides of the wall of the bathtub.

18 Claims, 13 Drawing Sheets

(56) References Cited

U.S. PATENT DOCUMENTS

| | | | |
|---|---|---|---|
| 4,351,348 | A | 9/1982 | Axton |
| 4,498,204 | A | 2/1985 | Warner |
| 4,725,027 | A | 2/1988 | Bekanich |
| 4,794,974 | A | 1/1989 | Melino |
| 4,907,835 | A | 3/1990 | Salters |
| 4,908,906 | A | 3/1990 | Hanna et al. |
| 4,928,916 | A | 5/1990 | Molloy |
| 4,932,090 | A | 6/1990 | Johansson |
| 5,056,753 | A | 10/1991 | Lunau et al. |
| 5,366,191 | A | 11/1994 | Bekanich |
| 5,516,158 | A | 5/1996 | Watts |
| 5,536,229 | A | 7/1996 | Albergo |
| 5,586,352 | A | 12/1996 | Obrien et al. |
| 5,711,555 | A | 1/1998 | Leedy |
| 5,826,847 | A | 10/1998 | Warner et al. |
| 5,876,147 | A | 3/1999 | Longo |
| 5,897,085 | A | 4/1999 | Cronin |
| 5,906,284 | A | 5/1999 | Hammerstrom et al. |
| 5,979,854 | A | 11/1999 | Lundgren et al. |
| 6,012,182 | A | 1/2000 | Allen et al. |
| 6,027,987 | A | 2/2000 | Yamazaki et al. |
| 6,068,225 | A | 5/2000 | Obrien et al. |
| 6,322,110 | B1 | 11/2001 | Banker et al. |
| 6,381,772 | B1 | 5/2002 | Dawson |
| 6,467,741 | B1 | 10/2002 | Shih |
| D470,581 | S | 2/2003 | Hoernig |
| D474,281 | S | 5/2003 | Hansen |
| 6,560,794 | B2 | 5/2003 | Allen et al. |
| 6,745,785 | B2 | 6/2004 | Kotovsky |
| 6,922,857 | B2 | 8/2005 | Palma |
| 7,124,451 | B2 | 10/2006 | Moore |
| 7,198,236 | B2 | 4/2007 | Warner |
| D584,129 | S | 1/2009 | Miller |
| 7,533,712 | B2 | 5/2009 | Whittemore et al. |
| 7,658,219 | B2 | 2/2010 | Whittemore |
| 7,849,564 | B2 | 12/2010 | Miller |
| 7,849,864 | B2 | 12/2010 | Matsumoto et al. |
| 7,874,881 | B1 | 1/2011 | Sosa et al. |
| 8,137,243 | B2 | 3/2012 | Coote |
| 8,827,587 | B2 | 9/2014 | Didehvar |
| 8,919,387 | B2 | 12/2014 | Martin |
| 9,200,732 | B2 | 12/2015 | Coogan et al. |
| 9,339,901 | B2 | 5/2016 | Miller |
| 9,468,573 | B2 * | 10/2016 | Edwards ..... A61G 7/1059 |
| 10,391,011 | B2 * | 8/2019 | Miller ..... A61G 7/1038 |
| 2004/0194418 | A1 | 10/2004 | Gouley |
| 2004/0217239 | A1 | 11/2004 | Chuang |
| 2006/0022098 | A1 * | 2/2006 | De Backer ..... A47K 1/08 248/215 |
| 2009/0283360 | A1 | 11/2009 | Eckerdt |
| 2014/0289955 | A1 * | 10/2014 | Hartis ..... A47K 3/001 29/525.01 |
| 2015/0219272 | A1 | 8/2015 | Miller |

OTHER PUBLICATIONS

Office Action dated Mar. 17, 2010 for U.S. Appl. No. 11/653,494.

Notice of Allowance dated Aug. 3, 2010 for U.S. Appl. No. 11/653,494.

Office Action dated Sep. 11, 2015 for U.S. Appl. No. 14/174,679.

Notice of Allowance dated Sep. 8, 2008 for U.S. Appl. No. 29/303,281.

"HealthCraft Dependa-Bar (installation instructions)", HealthCraft Products Inc., Ottawa, Ontario, Canada, http://www.healthcraftproducts.com, 2006.

"HealthCraft Dependa-Bar (website download)", HealthCraft Products Inc., Ottawa, Ontario, Canada, http://web-archive.org/web/20051030030453/http>//www.healthcraftproducts.com/dependabar.htm, Oct. 30, 2005.

"JDC Supplies, Guardian Safe-T-Pole", accessed May 24, 2016.

"Mobility-Aids.com Brochure", accessed May 24, 2016.

"Senior Home Card Safety Products", Stander, Inc., http://stander.com/products, accessed May 24, 2016., May 24, 2016.

* cited by examiner

BATHTUB SUPPORT POLE

RELATED APPLICATIONS

This application claims priority to U.S. Provisional Application No. 63/491,912, filed on Mar. 23, 2023 and titled "BATHTUB SUPPORT POLE," which is hereby incorporated by reference in its entirety.

TECHNICAL FIELD

The present disclosure relates generally to mobility assistance devices. More specifically, the present disclosure relates to bathtub support poles to provide support to a user of a bathtub.

BRIEF DESCRIPTION OF THE DRAWINGS

The embodiments disclosed herein will become more fully apparent from the following description and appended claims, taken in conjunction with the accompanying drawings. The drawings depict only typical embodiments, which embodiments will be described with additional specificity and detail in connection with the drawings in which:

DETAILED DESCRIPTION

It will be readily understood that the components of the embodiments as generally described and illustrated in the Figures herein could be arranged and designed in a wide variety of different configurations. Thus, the following more detailed description of various embodiments, as represented in the Figures, is not intended to limit the scope of the disclosure, but is merely representative of various embodiments While the various aspects of the embodiments are presented in drawings, the drawings are not necessarily drawn to scale unless specifically indicated.

The phrase "coupled to" is broad enough to refer to any suitable coupling or other form of interaction between two or more entities, including mechanical. Two components may be coupled to each other even though they are not in direct contact with each other.

Figure 1:
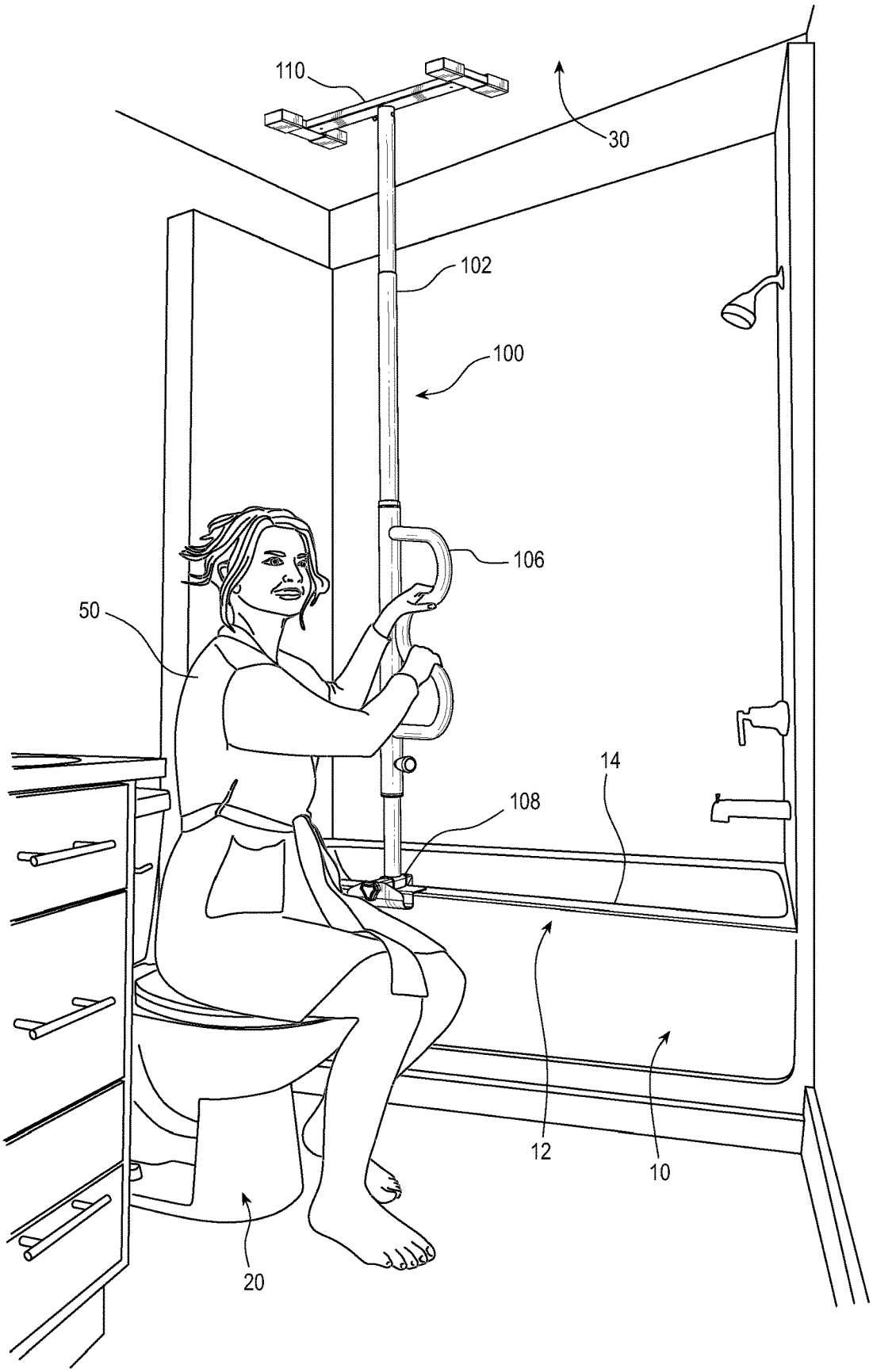
FIG. 1 is a perspective view of a bathtub support pole disposed between a bathtub and a ceiling, according to one embodiment of the present disclosure.

FIG. 1 is a perspective view of a bathtub support pole 100, according to one embodiment of the present disclosure. Devices, such as the bathtub support pole 100, may be considered mobility assistance devices, and may be used to assist individuals with disabilities and/or other infirmities that, in some cases, may be resulting from accidents, disease, age, or similar causes. Mobility assistance devices are designed to help these individuals get around a room and/or into and out of beds, chairs, toilets, bathtubs, and other similar furniture or fixtures. The bathtub support pole 100 is designed to help these individuals get around a bathroom and/or into and out of bathtub 10, toilets 20, and other common fixtures and features found within bathrooms.

A user may grasp various parts of the bathtub support pole 100, such as one or more handles 106 or the pole itself in order to stabilize themselves while entering/exiting the bathtub as well as to support themselves while standing in or about the bathtub. In the illustrated embodiment of FIG. 1, a user is grasping the handle 106 of the bathtub support pole 100 to help themselves stand up from the toilet 20.

The bathtub support pole 100 may be configured to be secured between a ceiling 30 and a wall 12 of the bathtub 10, thus providing a more compact profile without the need to occupy floor space. Furthermore, by mounting to a rim 14 of the wall 12 of the bathtub 10, the bathtub support pole 100 may offer additional stability and protection from inadvertent rotation of the bathtub support pole 100.

Figure 2A:
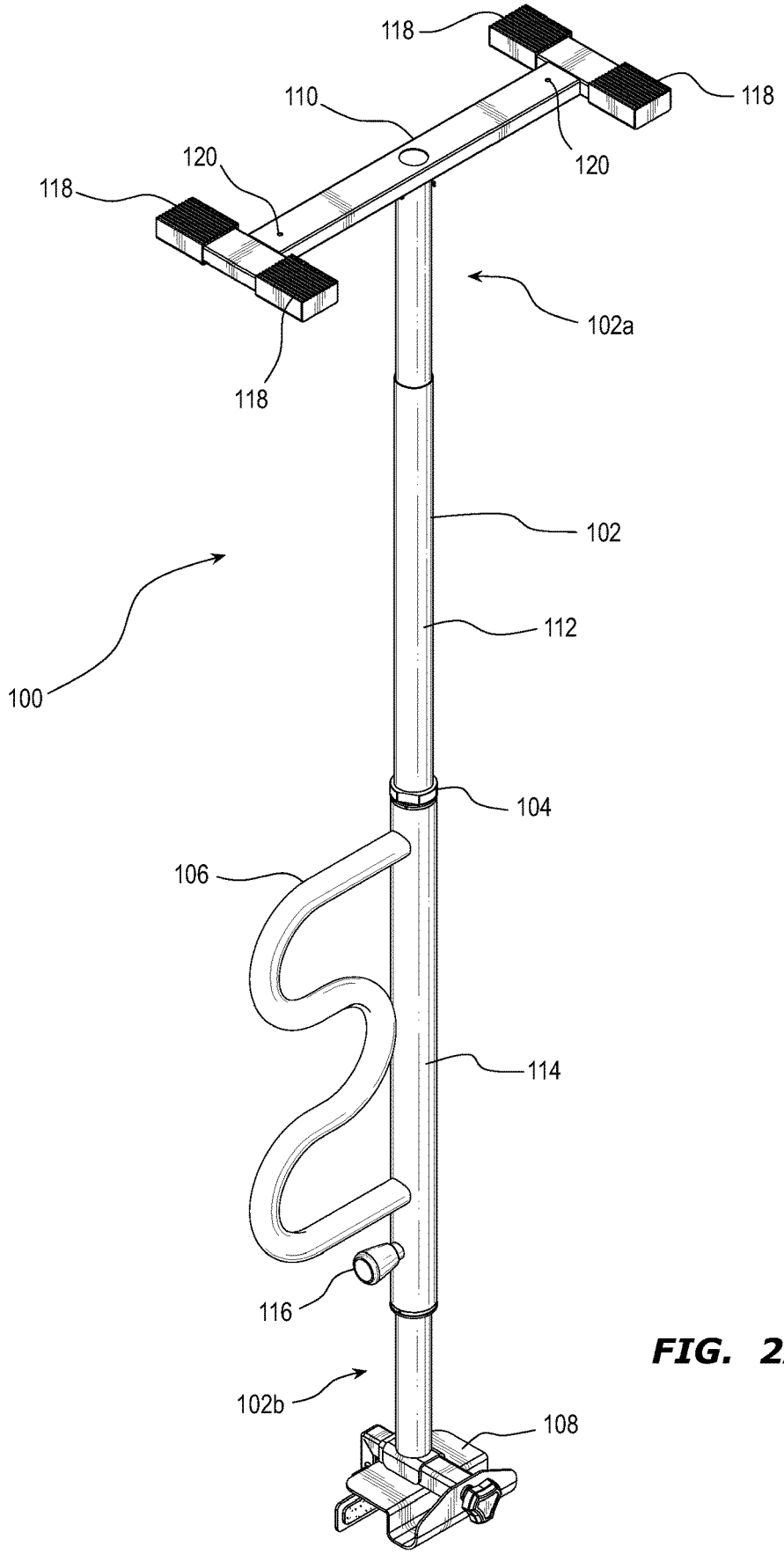
FIG. 2A is a top front perspective view of the bathtub support pole of FIG. 1.

FIG. 2A is a top front perspective view of the bathtub support pole 100 of FIG. 1. The bathtub support pole 100 may be a bathtub support device to provide support to assist a user that is in the bathtub or that is getting in or out of the bathtub. The bathtub support pole 100 may be configured to be fixated or secured between a ceiling and a wall of the bathtub. The bathtub support pole 100 includes a support member 102 and a height adjustment component 104 on the support member 102. In one embodiment, the bathtub support pole 100 further includes a handle 106, a bathtub mounting mechanism 108, and a ceiling mounting mechanism 110.

The support member 102 may include a first section 112 and a second section 114. The height adjustment component 104 may be located between the first section 112 and the second section 114 of the support member 102. In some embodiments, one or both of the first section 112 and 114 may be hollow, such that one section of the first and second sections 112 or 114 may be positionable within the other section of the first and second sections 114 or 112, thus allowing for the length of the support member to be adjustable (e.g., via a portion of one of the first or second sections 112, 114 sliding within the other section to lengthen or shorten the support member to a desired height). In some embodiments, the height adjustment component 104 may provide a constricting force to fixate a relative position between the first section 112 and the second section 114. In some embodiments, the height adjustment component 104 can exert a force along a longitudinal axis along a length of the support member 102 to secure the support member 102 between the ceiling and the wall of the bathtub. For example, the height adjustment component 104 can include one or more spring or elastic mechanisms to force the first section 112 towards the ceiling and the section towards the wall of the bathtub. The height adjustment component 104 can also be referred to as a height adjustment lock as it can lock the first and second sections 112, 114 at a desired length with respect to one another to hold a position and/or an applied force from the support member against the ceiling and/or bathtub. In some embodiments, the height adjustment component 104 may include a pin or other fastener to lock the relative position between the first section 112 and the second section 114.

The support member 102 has a first end 102*a* and a second end 102*b*. The first end 102*a* may be an end of the first section 112 coupled to the ceiling mounting mechanism 110; the second end 102*b* may be an end of the second section 114 coupled to the bathtub mounting mechanism 108. The height adjustment component 104 can hold an applied force, compress, or otherwise fix the first end 102*a* against the ceiling and the second end 102*b* against the wall of the bathtub.

The handle 106 is positionable along the support member 102 between the ceiling and the wall of the bathtub. In some embodiments, the handle 106 is fixed in place to either the first section 112 or the second section 114 of the support member 102. The handle 106 may be fixed with one or more fastener(s) 116, such as various fastening hardware (including torsion- or spring-based fasteners), adhesive, welding, molding, etc. In other embodiments, the handle 106 may be moveable along a length of the support member 102. The handle 106 may be configured to slide along the length of the support member 102 and be subsequently secured at a position along the length by fastening or tensioning mechanisms (such as constrictors, bands, screws, etc.). Further, the handle 106 may be rotatable about the longitudinal axis of the support member 102. For example, the user may rotate the handle 106 to extend from the support member 102 in a direction substantially parallel to the wall of the bathtub, a direction substantially orthogonal to the wall of the bathtub, or at an angle between parallel and orthogonal. In other embodiments, the handle 106 may extend from the support member 102 in multiple directions. For example, a section of the handle 106 may extend in a first direction from the support member 102, and one or more other sections of the support member 102 may extend in one or more other directions from the support member 102.

In some embodiments, the handle 106 may be a curved handle which includes one or more curved portions to operate as hand grips. The handle 106 may provide a structure which users can grasp to pull themselves to or hold themselves in a standing position.

The ceiling mounting mechanism 110 couples the first end 102*a* of the support member 102 to the ceiling. In some embodiments, the ceiling mounting mechanism 110 includes at least one fastening device (not shown), such as a nail, screw, etc., located at points 120 to secure the ceiling mounting mechanism 110 to the ceiling. The ceiling mounting mechanism 110 can include one or more extension arms that extend away from the support member 102. The one or more extension arms can also extend substantially perpendicular to the support member 102 and can provide an increased surface area at which the ceiling mounting mechanism 110 can abut and couple to the ceiling. The ceiling mounting mechanism 110 may also include pads 118 to be coupled between the ceiling and the ceiling mounting mechanism 110. The pads 118 may be rubber and/or textured in order to increase a coefficient of friction between the ceiling mounting mechanism 110 and the ceiling, so as to minimize the risk of the ceiling mounting mechanism 110 sliding with respect to the ceiling.

The second end 102*b* of the support member 102 encompasses a portion of a rim of the bathtub and opposing sides of the wall of the bathtub. Specifically, the bathtub mounting mechanism 108 fixes the second end 102*b* of the support member 102 to the wall of the bathtub, in part by providing a compressive force to clamp opposing sides of the wall of the bathtub.

Figure 2B:
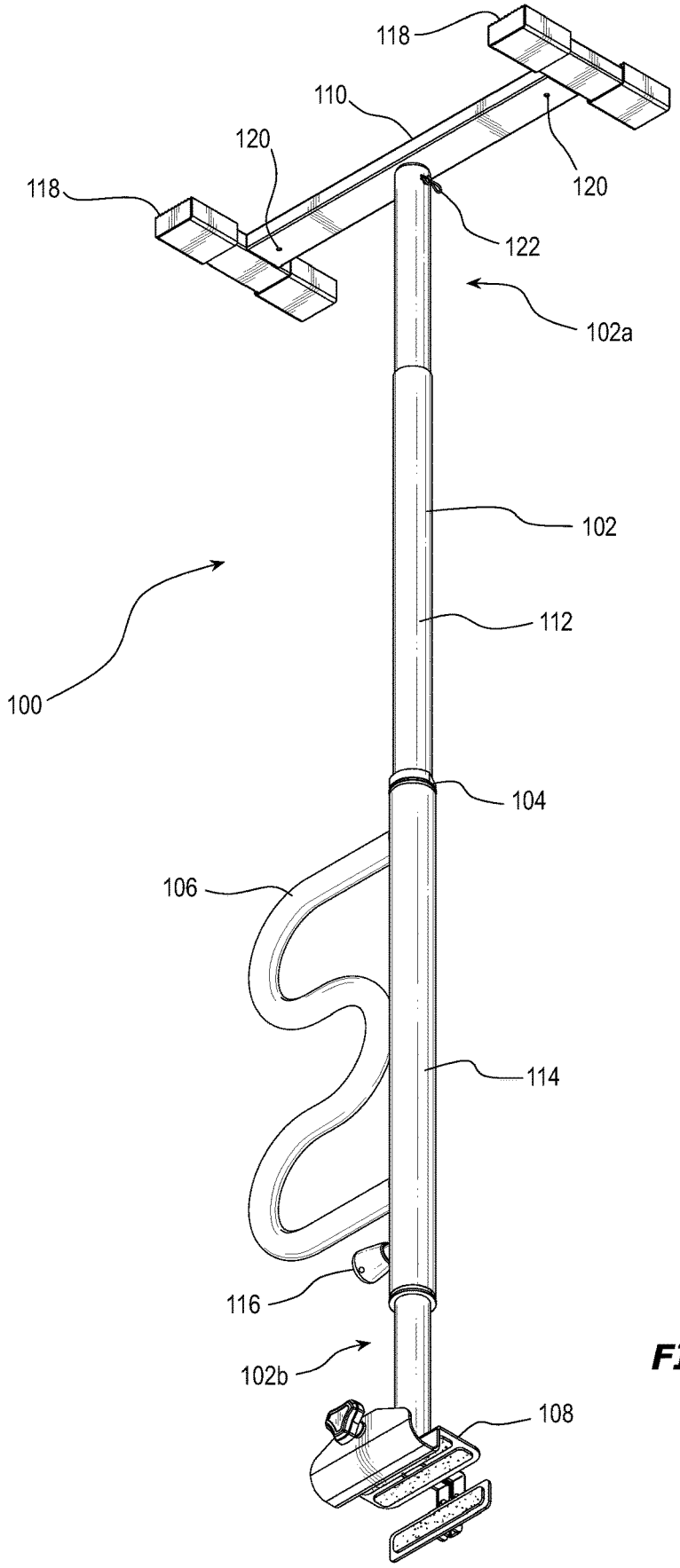
FIG. 2B is a bottom rear perspective view of the bathtub support pole of FIG. 1.

FIG. 2B is a bottom rear perspective view of the bathtub support pole 100 of FIG. 1. As depicted, the support member 102 and the ceiling mounting mechanism 110 may be coupled by a pin 122. The pin 122 may secure the ceiling mounting mechanism 110 to the support member 102, and may further prevent rotation of the support member 102 about its longitudinal axis and with respect to the ceiling mounting mechanism 110.

Figure 3A:
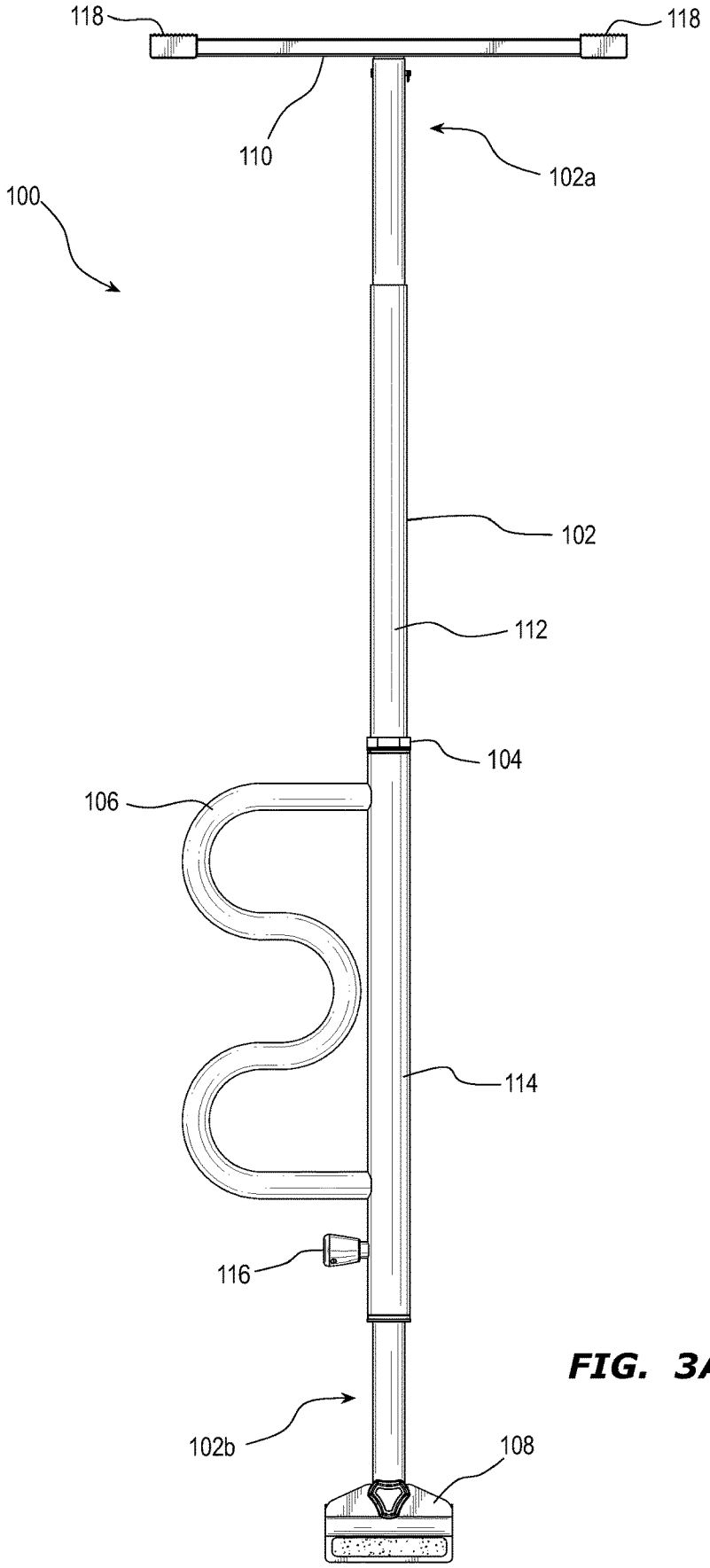
FIG. 3A is a front view of the bathtub support pole of FIG. 1.

FIG. 3A is a front view of the bathtub support pole 100 of FIG. 1.

Figure 3B:
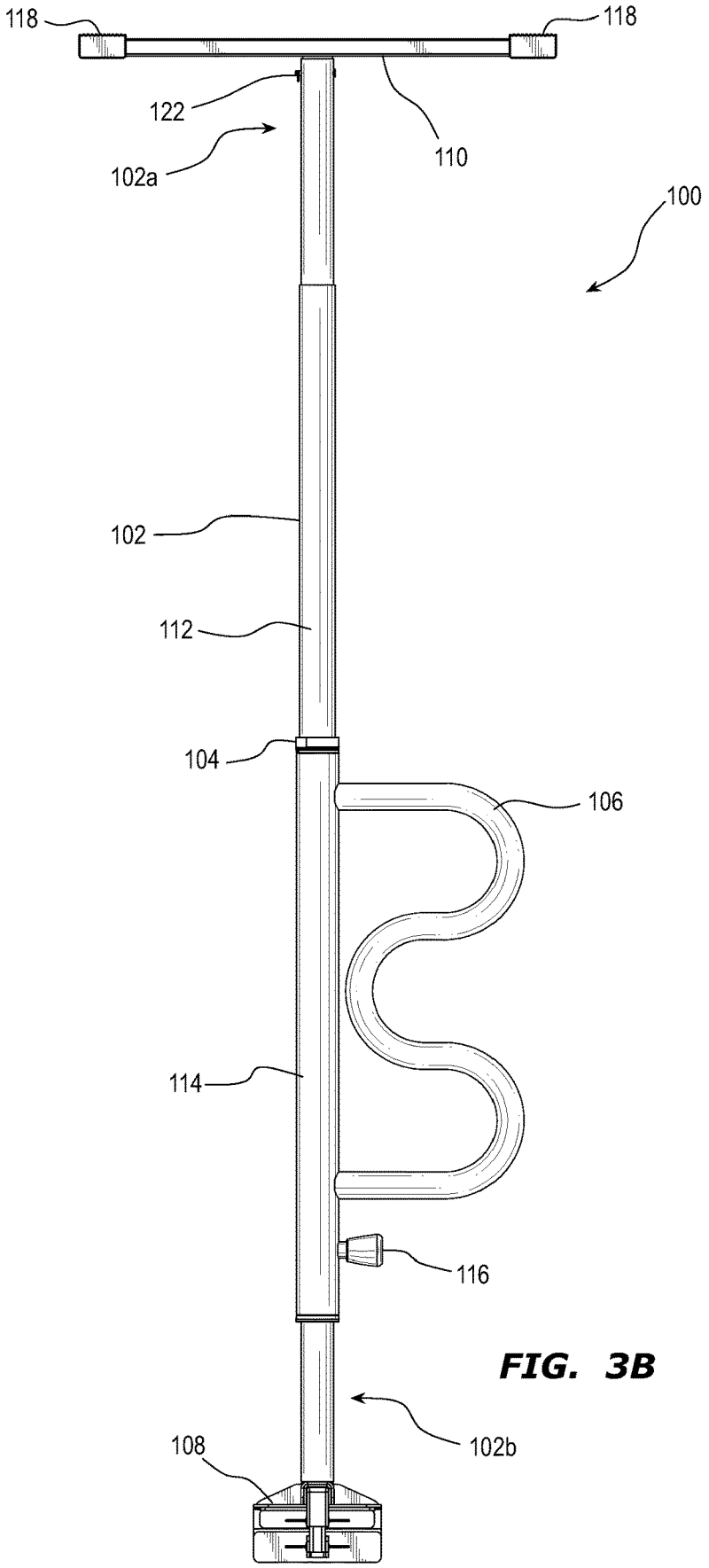
FIG. 3B is a rear view of the bathtub support pole of FIG. 1.

FIG. 3B is a rear view of the bathtub support pole 100 of FIG. 1.

Figure 4A:
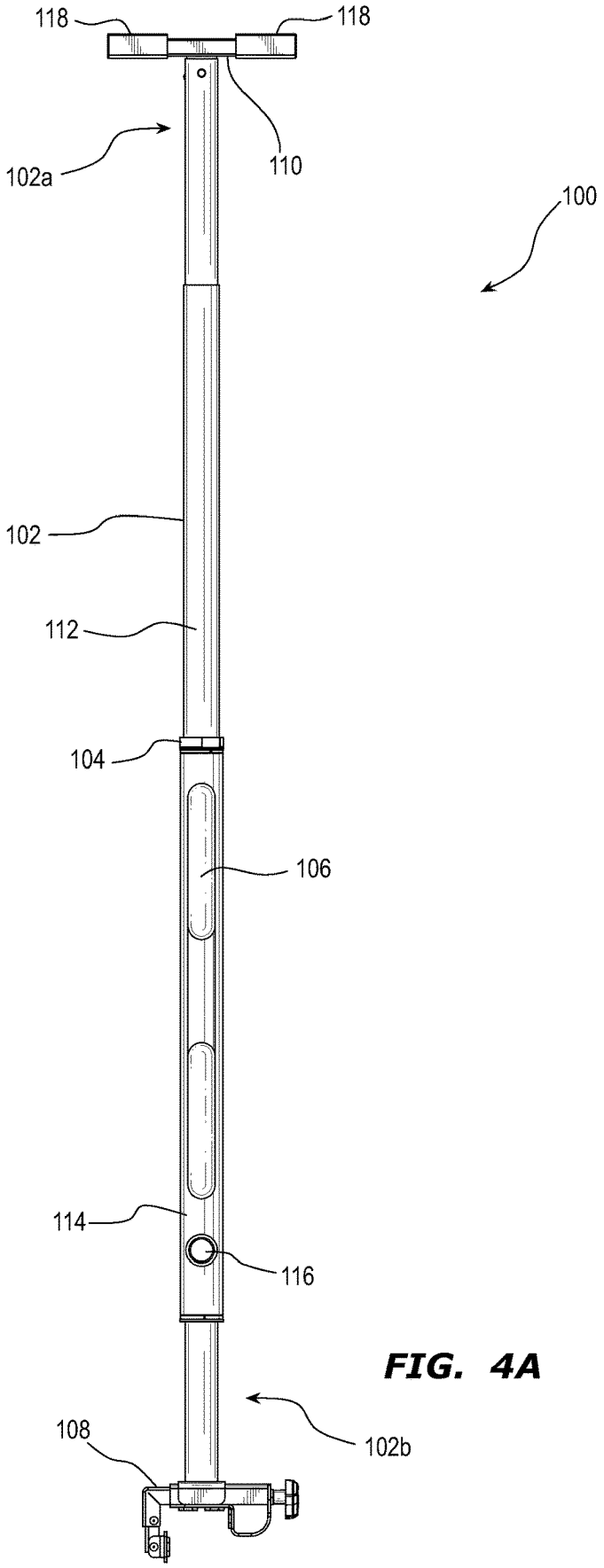
FIG. 4A is a left side view of the bathtub support pole of FIG. 1.

FIG. 4A is a left side view of the bathtub support pole 100 of FIG. 1.

Figure 4B:
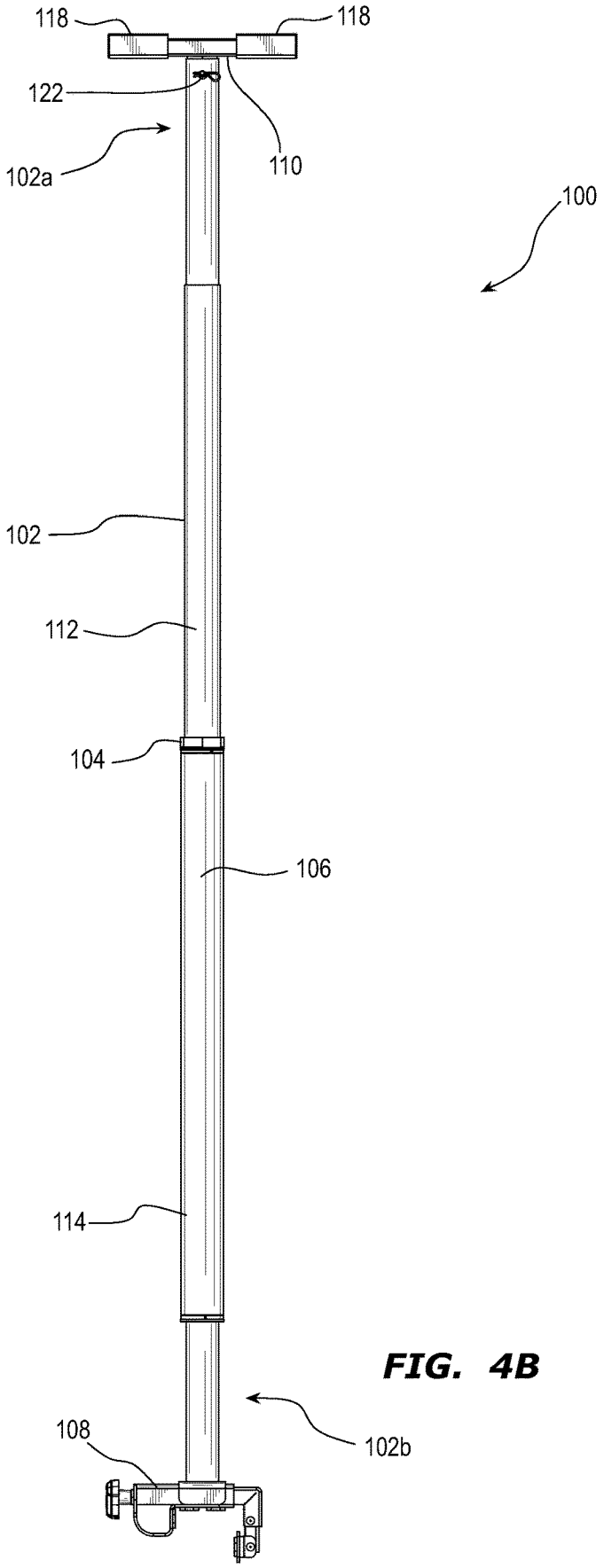
FIG. 4B is a right side view of the bathtub support pole of FIG. 1.

FIG. 4B is a right side view of the bathtub support pole 100 of FIG. 1.

Figure 5A:
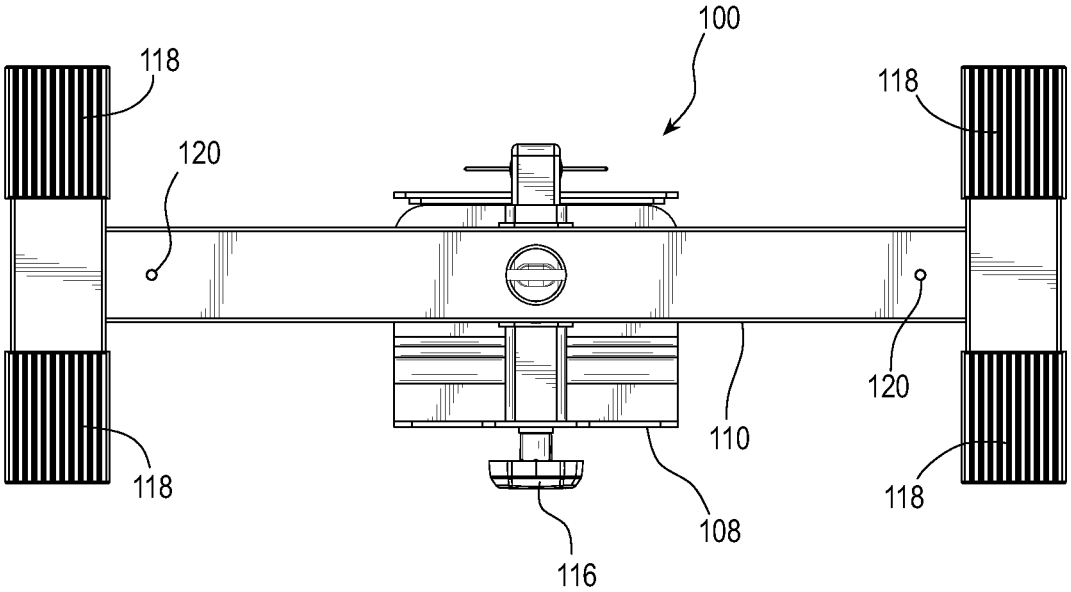
FIG. 5A is a top view of the bathtub support pole of FIG. 1.

FIG. 5A is a top view of the bathtub support pole 100 of FIG. 1.

Figure 5B:
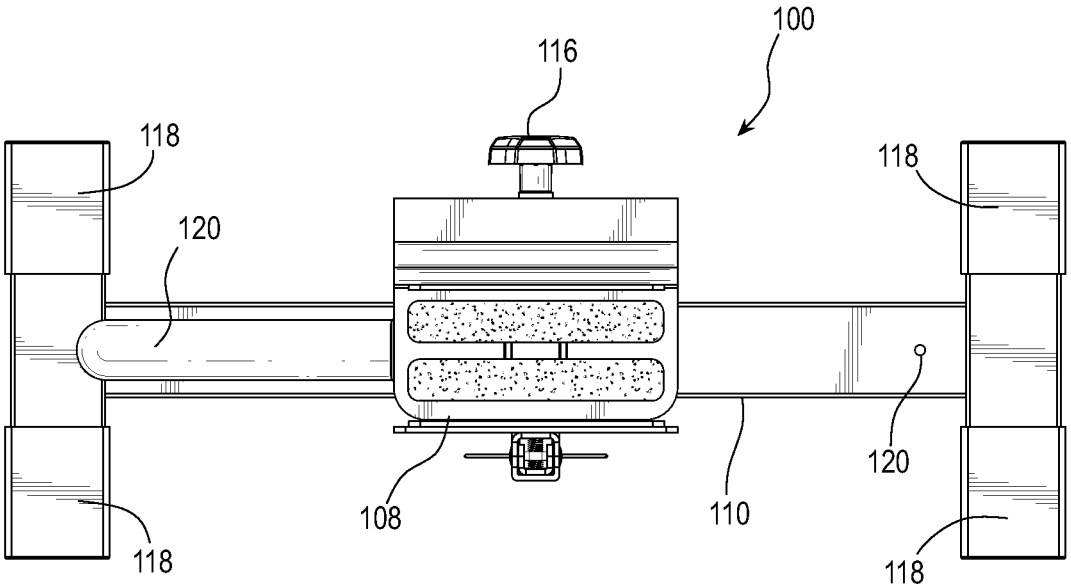
FIG. 5B is a bottom view of the bathtub support pole of FIG. 1.

FIG. 5B is a bottom view of the bathtub support pole 100 of FIG. 1.

Figure 6:
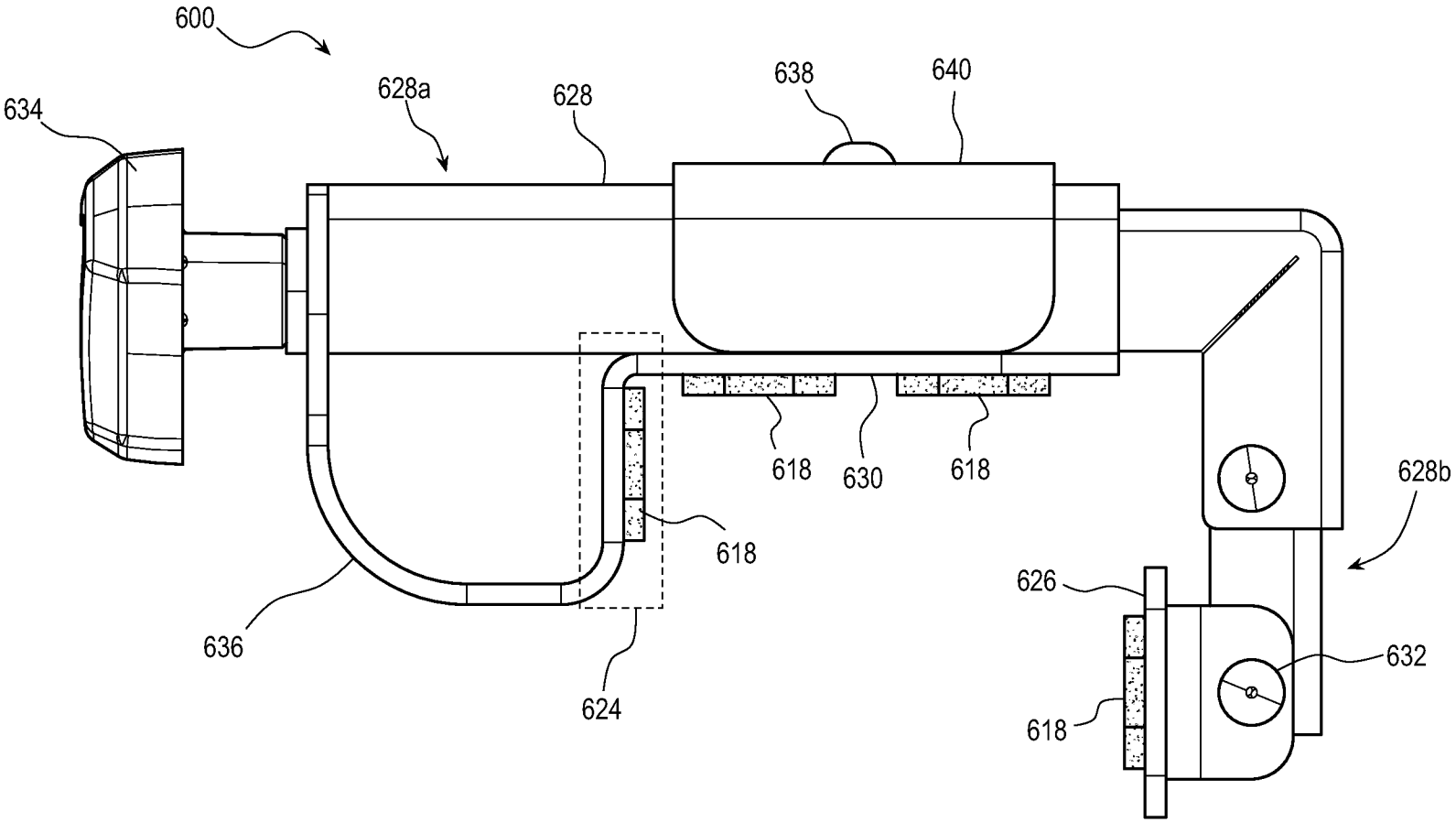
FIG. 6 is a bathtub mounting mechanism of a bathtub support pole according to one embodiment of the present disclosure.

FIG. 6 is a bathtub mounting mechanism 600 of a bathtub support pole according to one embodiment of the present disclosure. Although not all components are shown, the bathtub support pole may be the same as or similar to the bathtub support pole 100 of FIGS. 1-5B as indicated by the same or similar reference numbers. Although the bathtub mounting mechanism 600 is described in the context of the bathtub support pole 100, it is to be understood that the bathtub mounting mechanism 600 may be similarly used in combination with other types of support poles and bathtub support poles. The bathtub mounting mechanism 600 may be a clamping mechanism for the bathtub support pole to clamp one end of the bathtub support pole to the wall of the bathtub.

The bathtub mounting mechanism 600 can fix the second end 102*b* of the support member 102 to the wall of the bathtub. The bathtub mounting mechanism 600 includes a first wall portion 624, a second wall portion 626, and a connector 628. The connector 628 couples the first wall portion 624 to the second wall portion 626. In particular, the connector 628 provides a compressive force to bring the first wall portion 624 toward the second wall portion 626 to clamp against opposing sides of the wall of the bathtub. The bathtub mounting mechanism 600 further includes a rim portion 630 that is coupled to the first wall portion 624 and is configured to engage the rim of the bathtub. In other words, the first wall portion 624, the second wall portion 626, and the rim portion 630 encompasses a portion of a rim of the bathtub and opposing sides of the wall of the bathtub.

In some embodiments, the rim portion 630 and the first wall portion 624 may be integral. In some embodiments, one or more of the first wall portion 624, the second wall portion 626, and the rim portion 630 may include padding 618 to increase a frictional coefficient between each of the first wall portion 624, the second wall portion 626, the rim portion 630 and the opposing sides and rim of the wall of the bathtub.

The bathtub mounting mechanism 600 includes a rotatable joint 632 which allows an angle of the second wall portion 626 relative to the first wall portion 624 to be changed. In other words, the rotatable joint allows the relative angle between the second wall portion 626 and the first wall portion 624 to be changed, which may allow for the bathtub mounting mechanism 600 to accommodate and be mountable to a wider variety of bathtub wall shapes and slopes (e.g., those which may be tapered, uneven, or the like). The connector 628 includes a first section 628*a* and a second section 628*b* which are mutually perpendicular. The second wall portion 626 is coupled to the second section 628*b* of the connector 628 by the rotatable joint 632.

As briefly described above, the connector 628 provides a compressive force configured to bring the first wall portion 624 toward the second wall portion 626 to clamp opposing sides of the wall of the bathtub in order to secure the bathtub mounting mechanism 600 to the rim of the bathtub. More specifically, the connector 628 includes a screw 634 to generate the compressive force to bring the first wall portion 624 toward the second wall portion 626. In some embodiments, the screw 634 may instead be another type of tensioning mechanism, such as a spring or clamp.

The bathtub mounting mechanism 600 may include a curved portion 636. The first wall portion 624 is integral to and between the curved portion 636 and the rim portion 630.

The bathtub mounting mechanism 600 includes a protrusion 638 that projects upward from the connector 628. For example, the protrusion 638 may project from an upper surface of the connector 628 into the second end of the support member 102. The protrusion 638 helps secure the bathtub mounting mechanism 600 to the second end 102*b* of the support member 102. For example, when the bathtub support pole 100 is secured to the ceiling and the wall of the bathtub, the protrusion 638 prevents the second end 102*b* of the support member 102 from disconnecting from the bathtub mounting mechanism 600 when a shear force is applied to the support member 102 by a user when the user pushes on the support member 102 from the side. In other words, the protrusion 638 prevents the second end 102*b* of the support member 102 from sliding off of the bathtub mounting mechanism 600 when a shear force is applied to the support member 102. A lateral cross section of the protrusion 638 may be nonsymmetrical (e.g., it may be elliptical, rectangular, or other irregular shape). In some embodiments where the protrusion 638 has a nonsymmetrical shape, the protrusion may also prevent rotation of the support member 102 relative to the bathtub mounting mechanism 600. Other methods of coupling the bathtub mounting mechanism 600 to the support member 102 are also contemplated.

The connector 628 of the bathtub mounting mechanism 600 may further include one or more reinforcing members to reinforce the connector 628. For example, the connector 628 may include a first bracket 640 with an aperture (not shown in FIG. 6) for receiving the protrusion 638. The first bracket 640 partially encompasses the connector 628 at the protrusion 638 while the second end 102*b* of the support member 102 (not illustrated in FIG. 6) engages the first bracket 640.

Figure 7A:
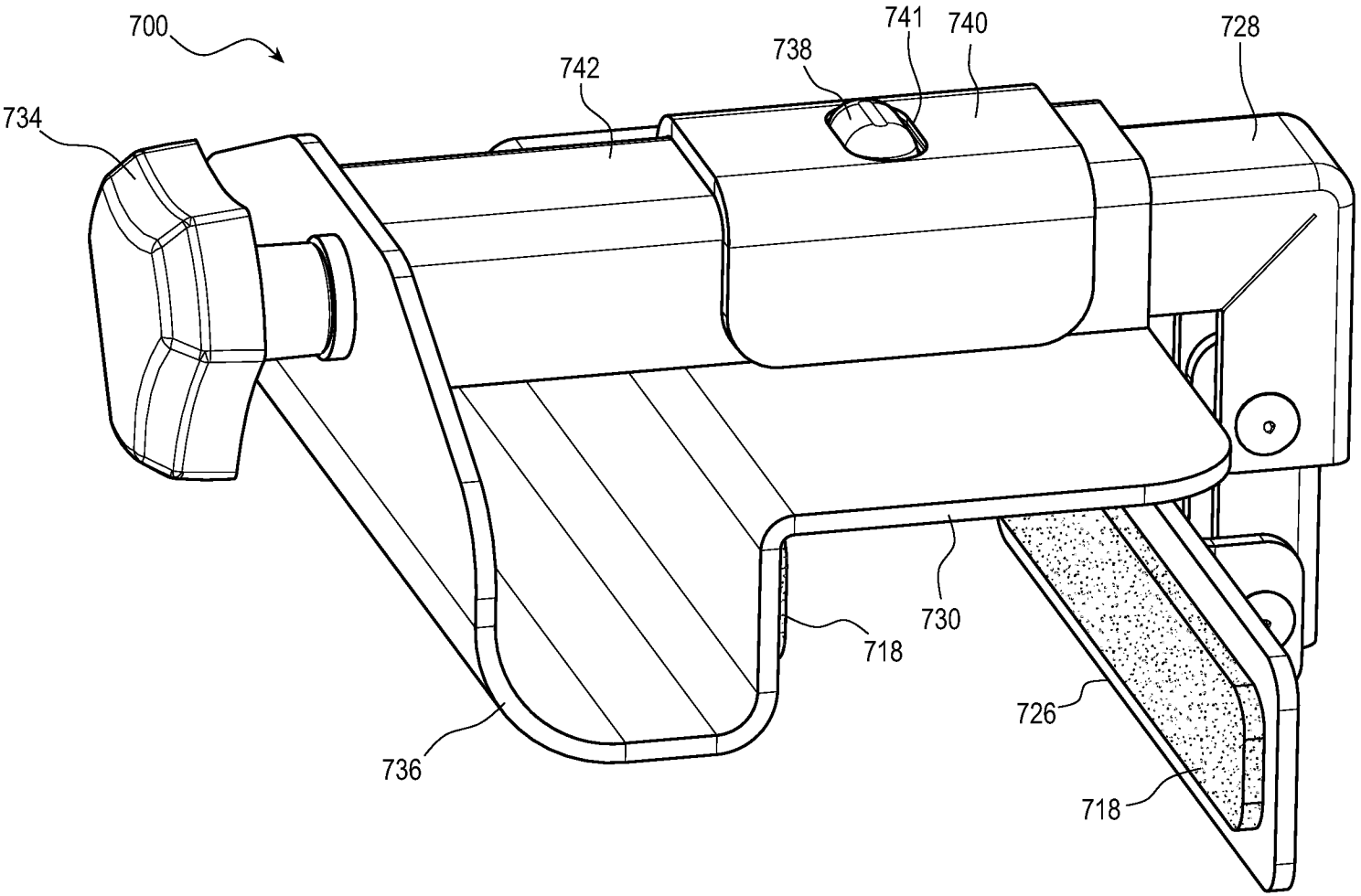
FIG. 7A is a perspective view of a clamping mechanism, according to one embodiment of the present disclosure.

FIG. 7A is a perspective view of a clamping mechanism 700, according to one embodiment of the present disclosure. Although not all components are shown, the clamping mechanism 700 may be the same as or similar to the bathtub mounting mechanism 108 of FIGS. 1-5B, or the bathtub mounting mechanism 600 of FIG. 6 as indicated by similar reference numbers.

The clamping mechanism 700 includes a first wall portion 724, a second wall portion 726, a rim portion 730, and a connector 728. The connector 728 further includes reinforcing members such as a first bracket 740 and a second bracket 742. In some embodiments, the first bracket 740 is fixed (e.g., welded) to the support member 102 and the second bracket 742 is fixed (e.g., welded) to the rim portion 730 and a curved portion 736. The first bracket 740 has an aperture 741 for receiving a protrusion 738 on the second bracket 742. The protrusion 738 projects upward from an upper surface of the second bracket 740. The first bracket 740 partially encompasses the second bracket 742 at the protrusion 738 and the second end 102*b* of the support member 102 (not illustrated in FIG. 7A, see FIGS. 7B-7D) engages the first bracket 740. The second bracket 742 partially encompasses the connector 728 and is disposed between the first bracket 740 and the connector 728 such that the aperture 741 of the first bracket 740 receives the protrusion 738 of the second bracket 742. As the connector 728 is configured to translate to apply a compressive force or relieve a compressive force, the second bracket 742 provides a pathway for the connector 728 to move back and forth.

The protrusion 738 may be receivable by the second end 102*b* (see FIGS. 7B-7D) of the support member 102, and the non-symmetric cross section of the protrusion 738 may be configured to prevent a rotation of the support member 102 along its longitudinal axis with respect to the clamping mechanism 700. In embodiments where the first bracket 740 is fixed relative to the support member 102 and the first bracket 740 partially encompasses the second bracket 742, the first bracket 740 is configured to prevent a rotation of the support member 102 along its longitudinal axis with respect to the clamping mechanism 700. In some embodiments, the second end of the support member 102 that receives the protrusion 738 includes a recess with a shape (or keyed connection interface) that matches the protrusion 738 to prevent to rotation of the support member 102.

Figure 7B:
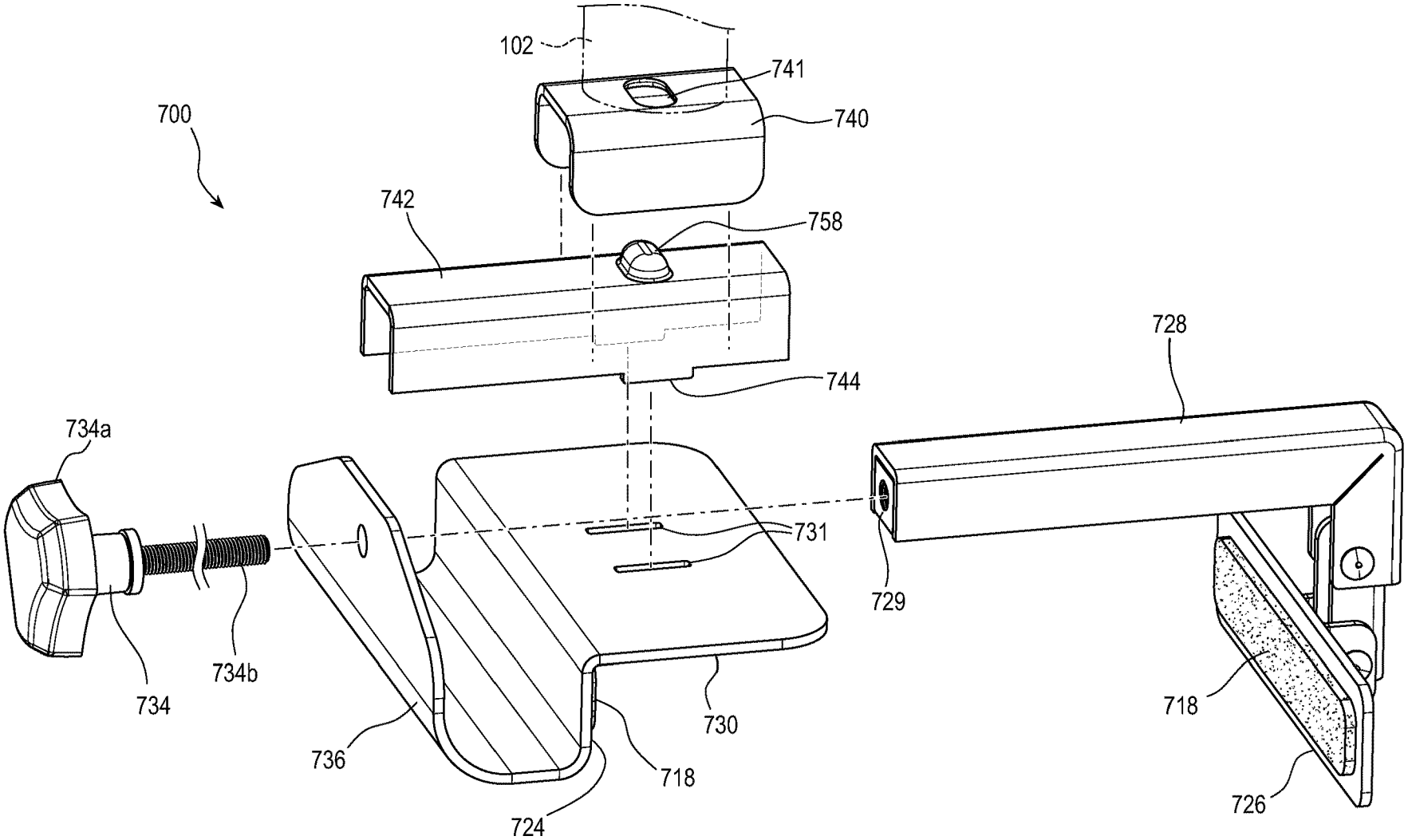
FIG. 7B is an exploded perspective view of the clamping mechanism of FIG. 7A.

As discussed above, the second bracket 742 may partially encompass the connector 728. FIG. 7B illustrates an exploded perspective view of the clamping mechanism 700. The second bracket 742 may include one or more mechanisms to secure the second bracket 742 to the rim portion 730. For example, the second bracket 742 may include tabs 744 extending toward the rim portion 730. The rim portion 730 may include apertures 731 for receiving the tabs 744 allowing the second bracket 742 to be secured to the rim portion 730 and the connector 728 to be disposed between the second bracket 742 and the rim portion 730. Further the clamping mechanism 700 includes a screw 734 to translate the connector 728 and provide the clamping force. The screw 734 includes the handle 734*a* and a threaded rod 734*b*.

Figure 7C:
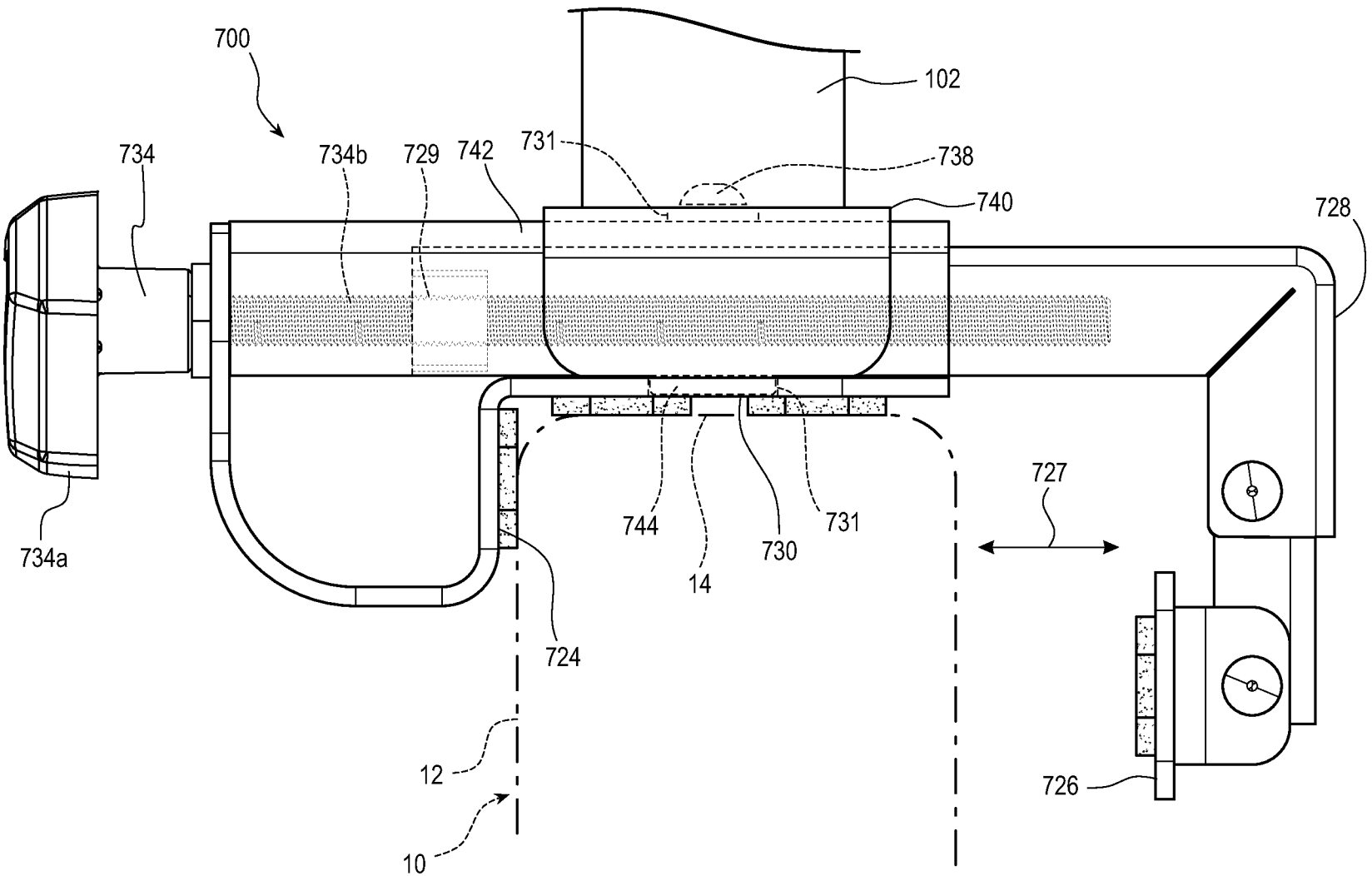
FIG. 7C is a right side view of the clamping mechanism of FIG. 7A in an expanded configuration to couple the clamping mechanism to a wall of a bathtub.
Figure 7D:
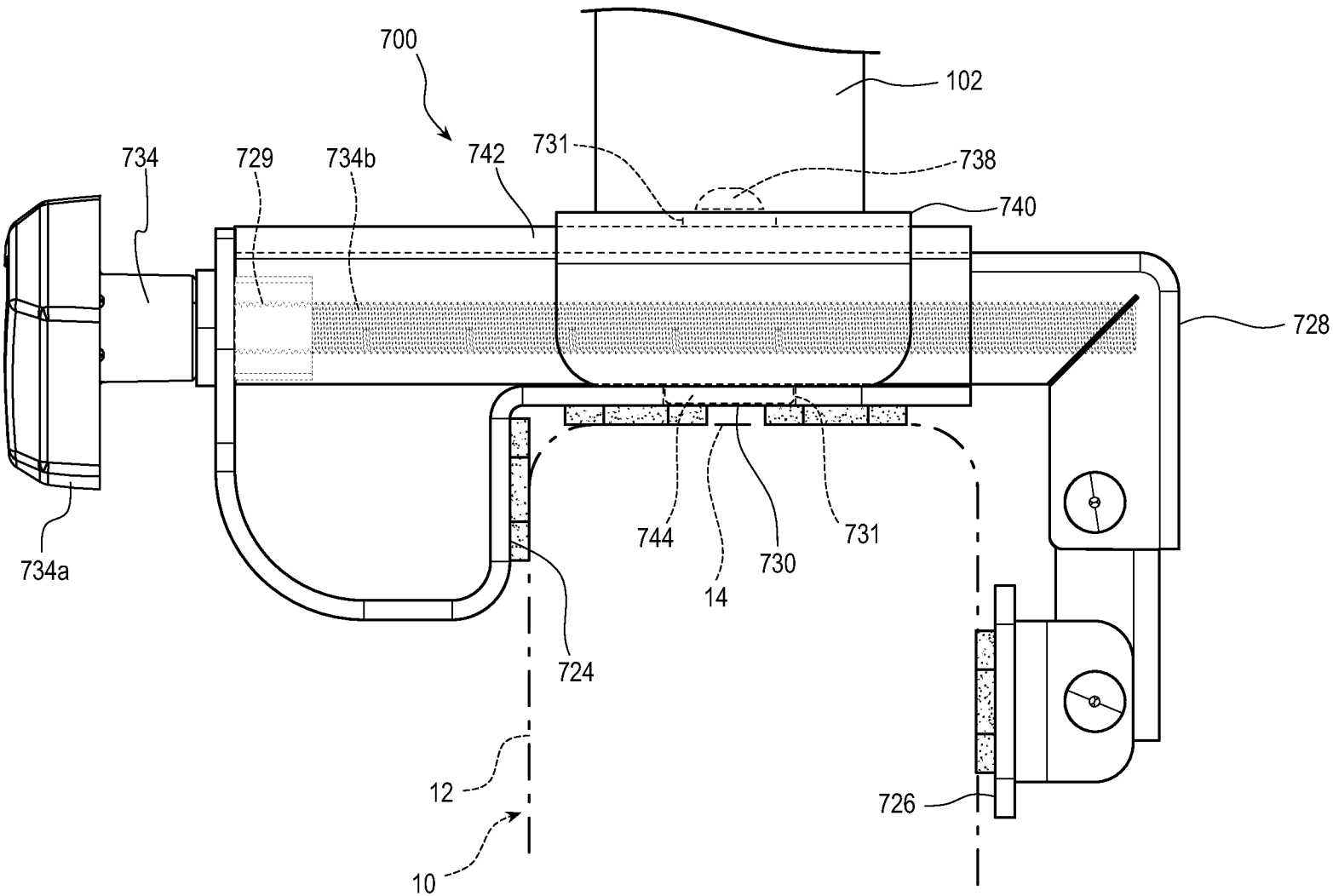
FIG. 7D is a right side view of the clamping mechanism of FIG. 7A in a clamped configuration with the clamping mechanism clamping the wall of the bathtub.

FIGS. 7C-7D are right side views of the clamping mechanism 700 coupled to a support member 102 showing the clamping member 700 clamping onto the wall 12 of a bathtub 10 according to one embodiment of the present disclosure. The internal components of the clamping device 700 are illustrated in broken lines. The protrusion 738 may be receivable by the second end 102*b* of the support member 102. As discussed above, the protrusion 738 helps secure the bathtub mounting mechanism 700 to the second end 102*b* of the support member 102. For example, when the bathtub support pole 100 is secured to the ceiling and the wall of the bathtub, the protrusion 738 prevents the second end 102*b* of the support member 102 from disconnecting from the bathtub mounting mechanism 600 when a shear force is applied to the support member 102 by a user when the user pushes on the support member 102 from the side. In other words, the protrusion 738 prevents the second end 102*b* of the support member 102 from sliding off of the bathtub mounting mechanism 700 when a shear force is applied to the support member 102. In some embodiments, the protrusion 738 may have a non-symmetric cross section which may be configured to prevent a rotation of the support member 102 along its longitudinal axis with respect to the clamping mechanism 700. In embodiments where the first bracket 740 is fixed relative to the support member 102 and the first bracket 740 partially encompasses the second bracket 742, the first bracket 740 is configured to prevent a rotation of the support member 102 along its longitudinal axis with respect to the clamping mechanism 700. In some embodiments, the second end 102*b* of the support member 102 that receives the protrusion 738 includes a recess (or keyed connection interface) with a shape that matches the protrusion 738 to prevent to rotation of the support member 102.

The connector 728 is configured to translate to enable the second wall portion 726 to move toward the first wall portion 724 to apply a compressive force to the wall 12 of the bathtub 10 with the rim portion 730 engaging the rim 14 of the bathtub 10. The connector 728 comprises a threaded nut 729 (see also FIG. 7B) fixed to and disposed at an end of the connector 728. A screw 734 (see also FIG. 7B) is insertable into the threaded nut 729.

The screw 734 may include a handle 734*a* and a threaded rod 734*b*. The handle 734*a* may be turned by the user to adjust the compressive force between the first wall portion 724 and the second wall portion 726, e.g., when installing, moving, or removing the clamping mechanism 700 along the wall of the bathtub. For example, as the screw 734 is rotated, the connector 728 is translated in one of two opposite directions as shown by arrow 727. In a first direction, the second wall portion 726 moves toward the first wall portion 724 and in a second direction, the second wall portion 726 moves away from the first wall portion 724.

FIG. 7C illustrates the clamping members 700 disposed around the rim 14 of the wall 12 of the bathtub 10 in an expanded configuration with a space between the second wall portion 726 and the wall 12 of the bathtub. As a user rotates the handle 734*a* of the screw 734 in a predetermined direction, the connector 728 moves the second wall portion 726 toward the wall 12 of the bathtub 10 to thereby clamp and fix the clamping mechanism 700 at a desired position on the bathtub 10. FIG. 7D illustrates the first wall portion 724 and the second wall portion 726 of the clamping mechanism 700 in a clamped configuration engaging opposing sides of the wall 12 of the bathtub 10. The handle 734*a* may be rotated in the opposite predetermined direction to relieve the compressive force to remove the clamping member 700 from the side 12 of the bathtub 10.

While specific embodiments of bathtub support poles have been illustrated and described, it is to be understood that the disclosure provided is not limited to the precise configuration and components disclosed. Various modifications, changes, and variations apparent to those of skill in the art may be made in the arrangement, operation, and details of the methods and systems disclosed, with the aid of the present disclosure.

References to approximations are made throughout this specification, such as by use of the term "substantially." For each such reference, it is to be understood that, in some embodiments, the value, feature, or characteristic may be specified without approximation. For example, where qualifiers such as "about" and "substantially" are used, these terms include within their scope the qualified words in the absence of their qualifiers. For example, where the term "substantially parallel" is recited with respect to a feature, it is understood that in further embodiments, the feature can have a precisely parallel configuration.

Similarly, in the above description of embodiments, various features are sometimes grouped together in a single embodiment, figure, or description thereof for the purpose of streamlining the disclosure. This method of disclosure, however, is not to be interpreted as reflecting an intention that any claim require more features than those expressly recited in that claim. Rather, as the following claims reflect, inventive aspects lie in a combination of fewer than all features of any single foregoing disclosed embodiment.

The claims following this written disclosure are hereby expressly incorporated into the present written disclosure, with each claim standing on its own as a separate embodiment. This disclosure includes all permutations of the independent claims with their dependent claims. Moreover, additional embodiments capable of derivation from the independent and dependent claims that follow are also expressly incorporated into the present written description.

Without further elaboration, it is believed that one skilled in the art can use the preceding description to utilize the invention to its fullest extent. The claims and embodiments disclosed herein are to be construed as merely illustrative and exemplary, and not a limitation of the scope of the present disclosure in any way. It will be apparent to those having ordinary skill in the art, with the aid of the present disclosure, that changes may be made to the details of the above-described embodiments without departing from the underlying principles of the disclosure herein. In other words, various modifications and improvements of the embodiments specifically disclosed in the description above are within the scope of the appended claims. Moreover, the order of the steps or actions of the methods disclosed herein may be changed by those skilled in the art without departing from the scope of the present disclosure. In other words, unless a specific order of steps or actions is required for proper operation of the embodiment, the order or use of specific steps or actions may be modified. The scope of the invention is therefore defined by the following claims and their equivalents.

What is claimed is:

1. A bathtub support pole configured to be fixated between a ceiling and a wall of a bathtub, the bathtub support pole comprising: a support member having a first end mountable to a ceiling and a second end mountable to a wall of a bathtub; a height adjustment component disposed on the support member, the height adjustment component configured to lock a length of the bathtub support pole between the first end and the second end to fix the first end of the support member against the ceiling and the second end of the support member against the wall of the bathtub; and a bathtub mounting mechanism fixing the second end of the support member to the wall of the bathtub, the bathtub mounting mechanism comprising a first wall portion, a second wall portion, and a connector that couples the first wall portion to the second wall portion wherein the bathtub mounting mechanism encompasses is configured to encompass a portion of a rim of the bathtub and opposing sides of the wall of the bathtub; and wherein the connector comprises a first handle that is rotatable, wherein as the first handle is rotated the second wall portion is translated toward or away from the first wall portion to clamp or unclamp the bathtub mounting mechanism to opposing sides of the wall of the bathtub.

2. The bathtub support pole of claim 1, wherein the support member comprises a first section and a second section, the height adjustment component disposed between the first section and the second section.

3. The bathtub support pole of claim 1, further comprising a second handle disposed along the bathtub support pole and between the wall of the bathtub and the ceiling.

4. The bathtub support pole of claim 1, wherein the bathtub mounting mechanism further comprises a curved portion and a rim portion, wherein the first wall portion is integral to and between the curved portion and the rim portion, and wherein the curved portion projects away from an outer side of the wall of the bathtub when the bathtub mounting mechanism is clamped onto the wall of the bathtub.

5. The bathtub support pole of claim 1, wherein the bathtub mounting mechanism further comprises a rim portion configured to engage the rim of the bathtub, the rim portion coupled to the first wall portion, wherein the rim portion, the first wall portion, and the second wall portion each include padding to increase a frictional coefficient between each of the rim portion, the first wall portion, and the second wall portion and the opposing sides and rim of the wall of the bathtub.

6. The bathtub support pole of claim 1, wherein the connector comprises a rotatable joint to change an angle of the second wall portion relative to the first wall portion.

7. The bathtub support pole of claim 1, wherein a lateral cross section of the protrusion is nonsymmetrical.

8. The bathtub support pole of claim 1, wherein the bathtub mounting mechanism further comprises a bracket with an aperture for receiving the protrusion, wherein the bracket partially encompasses the connector at the protrusion and wherein the second end of the support member engages the bracket.

9. The bathtub support pole of claim 1, further comprising a ceiling mounting mechanism to couple the first end of the support member to the ceiling, the ceiling mounting mechanism comprising at least one fastening device to secure the ceiling mounting mechanism to the ceiling.

10. The bathtub support pole of claim 1, wherein the height adjustment component locks the length of the bathtub support pole such that the first end of the support member applies a force against the ceiling and the second end of the support member applies a force against the wall of the bathtub.

11. A clamping mechanism for a bathtub support pole comprising: a first wall portion; a second wall portion; and a connector that mechanically couples the first wall portion and the second wall portion, wherein the connector translates first wall portion toward the second wall portion to generate a compressive force and clamp opposing sides of a wall of a bathtub, and wherein an upper surface of the connector comprises a protrusion that projects upward from the connector and is configured to couple the clamping mechanism to a bathtub support poles; wherein the protrusion prevents a rotation of the bathtub support pole about a longitudinal axis of the bathtub support pole.

12. The clamping mechanism of claim 11, wherein the connector comprises a screw to translate the first wall portion toward the second wall portion.

13. The clamping mechanism of claim 11, further comprising a curved portion and a rim portion, wherein the first wall portion is integral to and between the curved portion and the rim portion, and wherein the curved portion projects away from an outer side of the wall of the bathtub when the clamping mechanism is clamped onto the wall of the bathtub.

14. The clamping mechanism of claim 11, wherein the connector comprises a first section and a second section perpendicular to the first section, and wherein the second wall portion is coupled to the connector by a rotatable joint.

15. A bathtub support device configured to be fixated between a ceiling and a rim of a bathtub, the support device comprising: a pole with a first end and a second end; a first mounting mechanism configured to couple the first end of the pole to the ceiling; and a second mounting mechanism configured to couple the second end of the pole to the rim of the bathtub, the second mounting mechanism comprising a protrusion that prevents rotation of the pole and is receivable by the second end of the pole.

16. The bathtub support device of claim 15, wherein the second mounting mechanism further comprises a first wall portion, a second wall portion, a rim portion, and a connector that couples the first wall portion to the second wall portion, wherein the connector translates the first wall portion toward the second wall portion to generate a compressive force and clamp opposing sides of a wall of the bathtub.

17. The bathtub support device of claim 16, wherein the second mounting mechanism comprises a first bracket and a second bracket and wherein:

the first bracket comprises an aperture for receiving the protrusion;

the second bracket comprises the protrusion and a plurality of tabs to secure the second bracket to the rim portion; and the second bracket is coupled between the first bracket and the connector.

18. The bathtub support device of claim 16, wherein the second wall portion is coupled to the connector by a rotatable joint.

* * * * *